US006439126B1

(12) United States Patent
Kennedy et al.

(10) Patent No.: US 6,439,126 B1
(45) Date of Patent: Aug. 27, 2002

(54) ENHANCED KINETIC ENERGY PROJECTILE

(75) Inventors: Kevin D. Kennedy, Madison; Brian J. Smith, Huntsville, both of AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/907,885

(22) Filed: Jul. 16, 2001

(51) Int. Cl.[7] ..... F42B 12/06

(52) U.S. Cl. ..... 102/516; 102/501; 102/517; 102/448

(58) Field of Search ..... 102/444, 448, 102/459, 460, 501, 502, 413–519, 529, 439

(56) References Cited

U.S. PATENT DOCUMENTS

| | | | | | |
|---|---|---|---|---|---|
| 2,306,140 | A | * | 12/1942 | Reed | 102/522 |
| 3,400,660 | A | * | 9/1968 | Malter | 102/459 |
| 4,167,904 | A | * | 9/1979 | Ferri | 102/457 |
| 4,718,348 | A | * | 1/1988 | Ferrigno | 102/501 |
| 4,996,924 | A | * | 3/1991 | McClain | 102/501 |
| 5,016,536 | A | * | 5/1991 | Brighton | 102/444 |
| 5,877,437 | A | | 3/1999 | Oltrogge | 75/228 |

FOREIGN PATENT DOCUMENTS

| | | | | |
|---|---|---|---|---|
| DE | 4135466 | * | 4/1993 | 102/501 |
| IT | 464694 | * | 6/1952 | 102/460 |

* cited by examiner

*Primary Examiner*—Harold J. Tudor
(74) *Attorney, Agent, or Firm*—Arthur H. Tischer; Freddie M. Bush; Hay Kyung Chang

(57) ABSTRACT

A steel projectile assuming the general shape of a teardrop compensates for the lower density of the material as compared to lead and still achieves penetration into the target that is comparable to spherical lead pellets. Additional benefit of the elongated exterior geometry of the projectile is less scatter and less aerodynamic drag during flight.

2 Claims, 6 Drawing Sheets

ENHANCED KINETIC ENERGY PROJECTILE

DEDICATORY CLAUSE

The invention described herein may be manufactured, used and licensed by or for the Government for governmental purposes without the payment to us of any royalties thereon.

BACKGROUND OF THE INVENTION

Contemporary forces using shoulder-fired weapons utilize multiple projectile munitions, typically spherical pellets. The term for such weapons firing multiple projectiles is a "shotgun" and the cartridges "shotgun shells."

The benefits of shotguns for military applications are the ability to hit rapidly moving personnel and vehicles at close ranges, ability to engage large numbers of closely spaced personnel and the ability to engage them in limited visibility scenarios (e.g. thick foliage). All commercially available shotgun shells use spherical projectiles because they are easy to manufacture and to load into the cartridges. However, there are two major problems with spherical pellets: 1. they scatter randomly after they leave the muzzle of the gun, thereby increasing the likelihood of causing casualties among non-combatants, and 2. they rapidly slow down in flight due to aerodynamic inefficiency.

The classic approach to extending the range of shotgun pellets is to use denser pellet material. Traditionally, shotgun pellets have been made of lead, which is one of the heavier elements yet easy to manipulate during manufacture. Using alloys containing tungsten, uranium, etc. has been considered but has not met wide-spread use due to cost, marginal performance improvement and material hardness which renders the material difficult to work with. One notable application where materials other than lead have been used in pellet construction is in non-toxic shots. Non-toxic shots are required in the United States for certain activities such as hunting waterfowl. Unfortunately, though, these non-toxic shot materials are high in cost. Commercial shells made of compounds of bismuth and tungsten are typically three to four times more expensive than corresponding lead shells. Currently available steel shells cost approximately 100% more than corresponding lead shells, while lagging far behind the lead shells in performance. The reason for the lackluster performance is that steel is only 71% as dense as lead, which means that a steel projectile of the same size as a lead projectile has less kinetic energy and corresponding less penetration than the lead projectile.

SUMMARY OF THE INVENTION

The instant invention is a steel projectile assuming the general shape of a teardrop. This elongated exterior geometry enables the steel projectile to compensate for the lower density of the material as compared to lead and achieve penetration into the target that is comparable to spherical lead pellets while suffering less scatter and aerodynamic drag (i.e. being more directional).

DESCRIPTION OF THE PREFERRED EMBODIMENT

Figure 1:
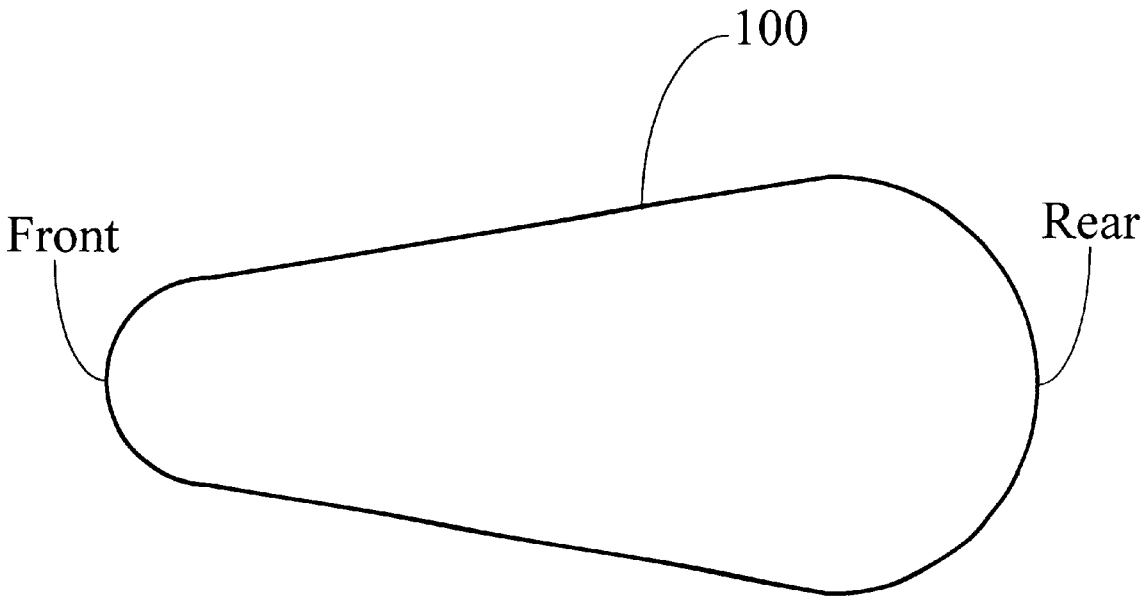
FIG. 1 illustrates the general shape of enhanced kinetic energy projectile.

Referring now to the drawing wherein like numbers represent like parts in each of the several figures, FIG. 1 depicts the general teardrop shape of the enhanced kinetic energy projectile 100, the smaller-radius area being the front end so as to minimize the pressure drag during the flight of the projectile.

Figure 2:
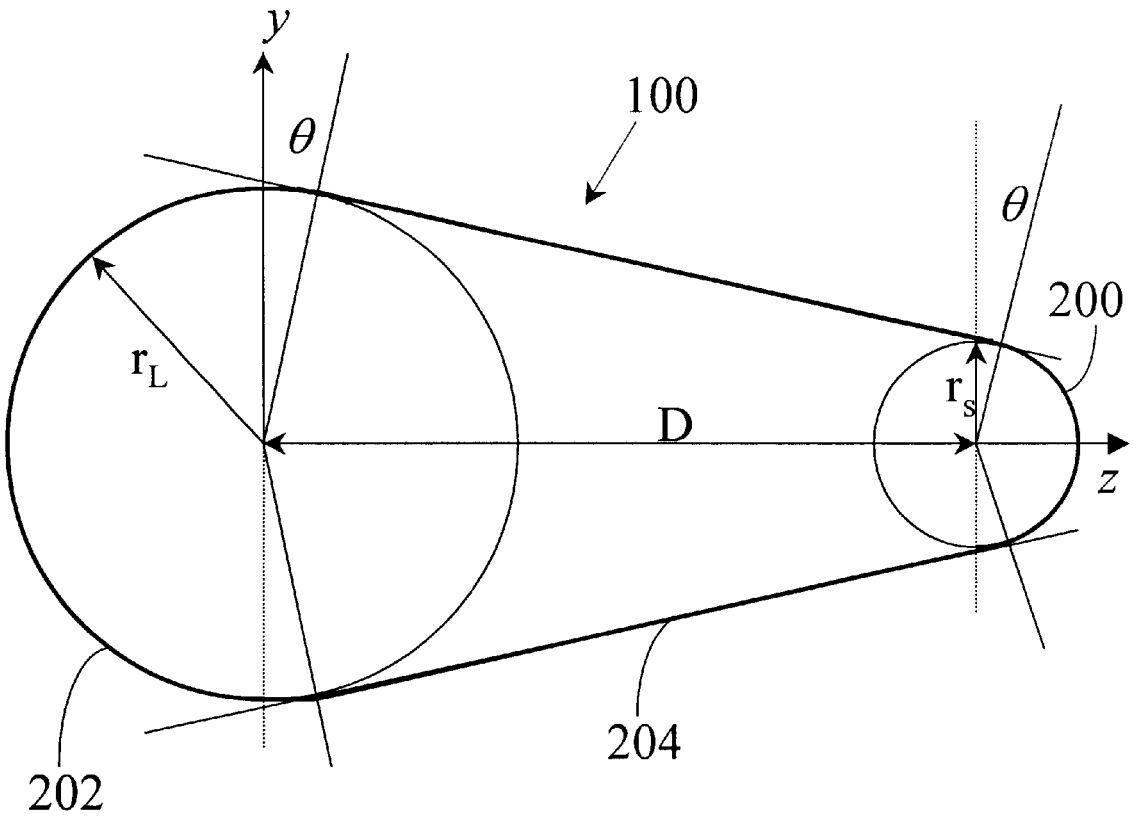
FIG. 2 is a detailed illustration of the structure of the projectile.
Figure 3:
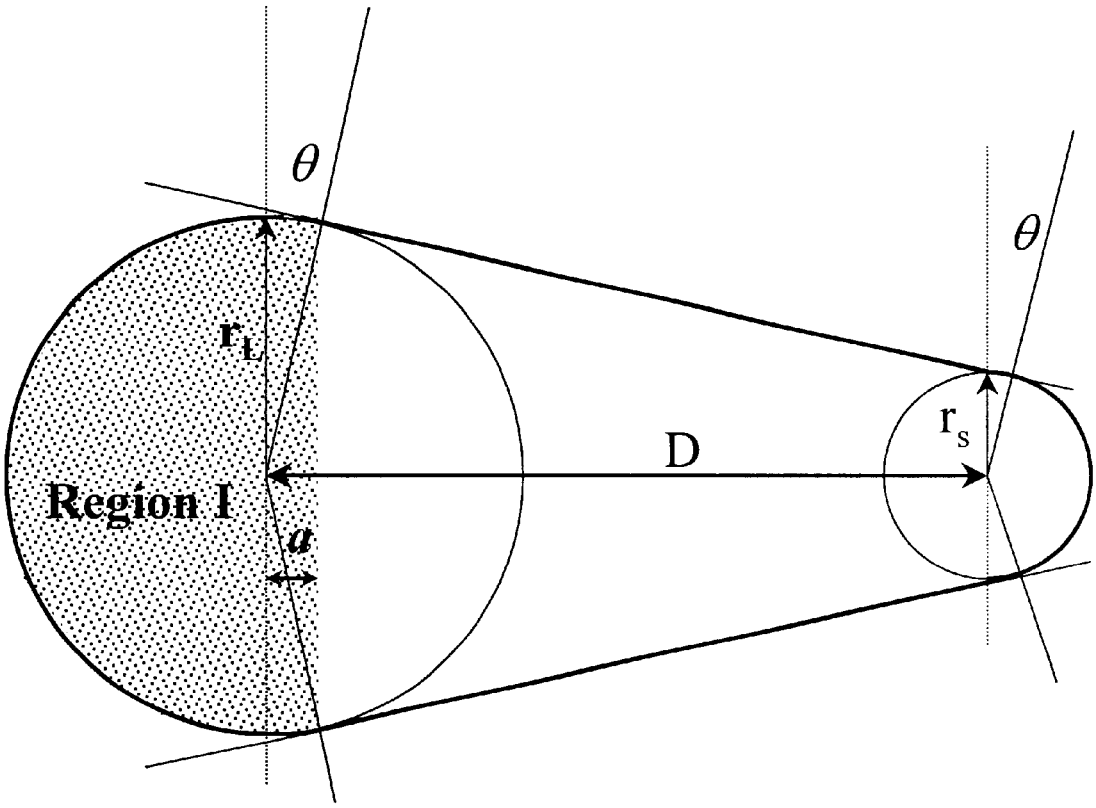
FIG. 3 shows Region I for volume calculation.
Figure 4:
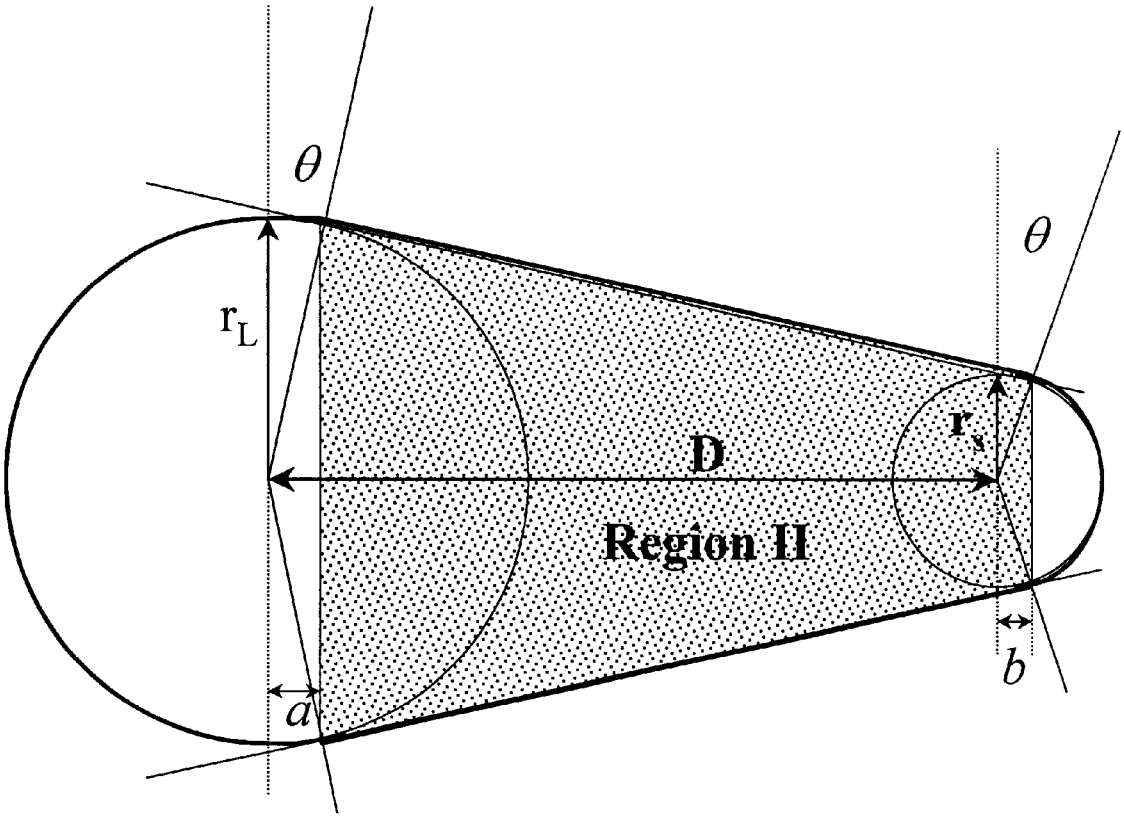
FIG. 4 shows Region II for volume calculation.
Figure 5:
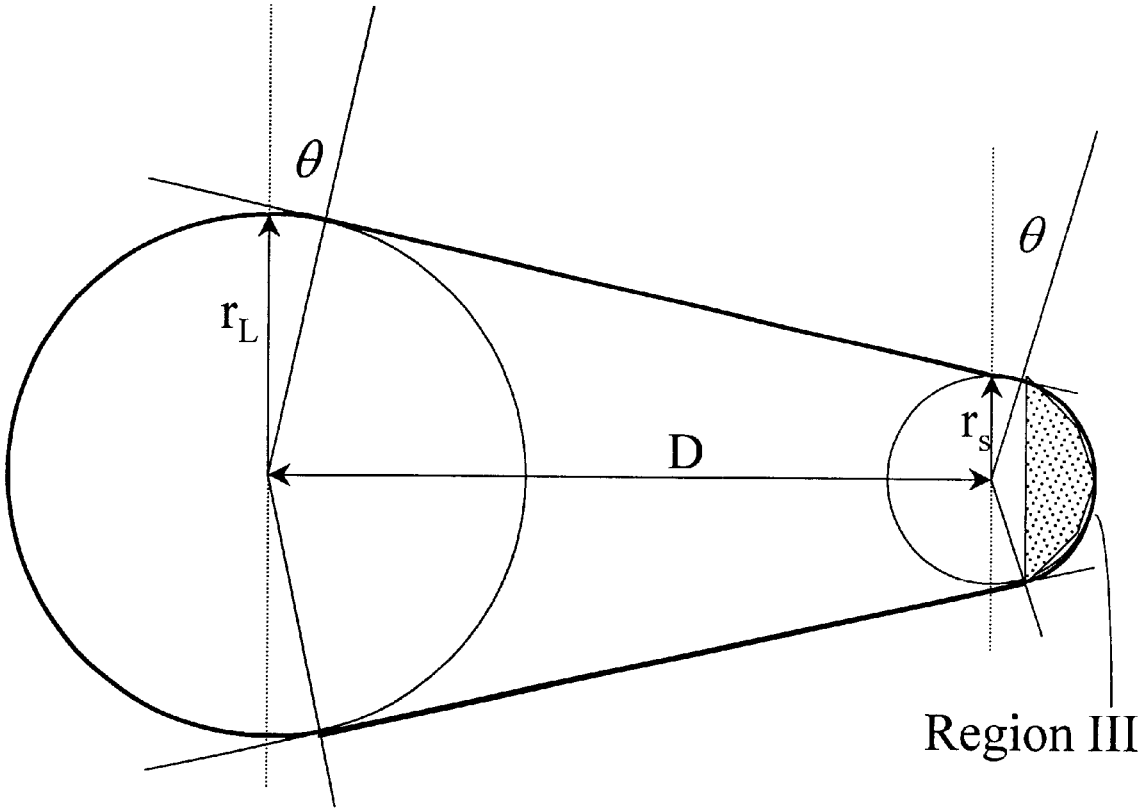
FIG. 5 shows Region III for volume calculation.

As detailed in FIG. 2, projectile 100 can be deemed to be made of three segments that are integrated together. At the front end is small sphere 200, large sphere 202 at the rear end and tapered segment 204 connecting the two spheres. There are three parameters that need to be chosen carefully when fabricating the projectile, taking into consideration factors such as the distance to be traveled by the projectile and the desired velocity of the travel. These parameters are $r_L$, $r_s$ and D, denoting, respectively, the radius of large sphere 202, the radius of small sphere 200 and the distance between the centers of the spheres 200 and 202. To be effective in maintaining the desired flight path and achieving penetration at the intended target, D should be equal to or greater than the sum of $r_L$ and $r_s$. Another factor that impacts the effectiveness of the penetration and the ability to fly straight at the target is the weight of the projectile. Generally, given the same volume, the heavier projectile achieves straighter flight path and deeper penetration than the lighter projectile. The weight being simply the product of the total volume and the density of the material, it is then important to calculate and control the desired volume. It is instructive now to review the method of calculating the volume of the projectile as it is depicted in FIG. 1. For this purpose, the projectile is divided into three regions, as depicted by speckled areas in FIGS. 3, 4 and 5. The volume of region I is given by $$V_I = \pi\left[ar_L^2 - \frac{1}{3}a^3 + \frac{2}{3}r_L^3\right] \tag{1}$$

where $a=r_L \sin(\theta)$ and $\theta=\sin^{-1}$ $$\theta = \sin^{-1}\left(\frac{r_L - r_s}{D}\right).$$

The volume of Region II, using the circular cylindrical coordinate system to facilitate integration, is given by $$V_{II} = \pi\left[\frac{1}{3}m^2\{(D+b)^3 - a^3\} + mr_3\{(D+b)^2 - a^2\} + r_3^2(D+b-a)\right] \tag{2}$$

where $$r_3 = \frac{r_L}{\cos(\theta)},$$

$m=-\tan(\theta)$ and $b=r_s \sin(\theta)$.

Finally, the volume of Region III is given by $$V_{III} = \pi\left[\frac{2}{3}r_s^3 - br_s^2 + \frac{1}{3}b^3\right] \tag{3}$$

The total volume of the projectile is simply the sum of $V_I$, $V_{II}$, and $V_{III}$ and the weight is the product of the total volume and the density of the given material.

The teardrop shape of the projectile causes it to suffer less aerodynamic drag than a spherical projectile of equal volume while pressure drag and skin friction drag can be minimized by controlling $r_s$ and D, respectively (i.e. each type of drag increases as the corresponding dimension increases).

Figure 6:
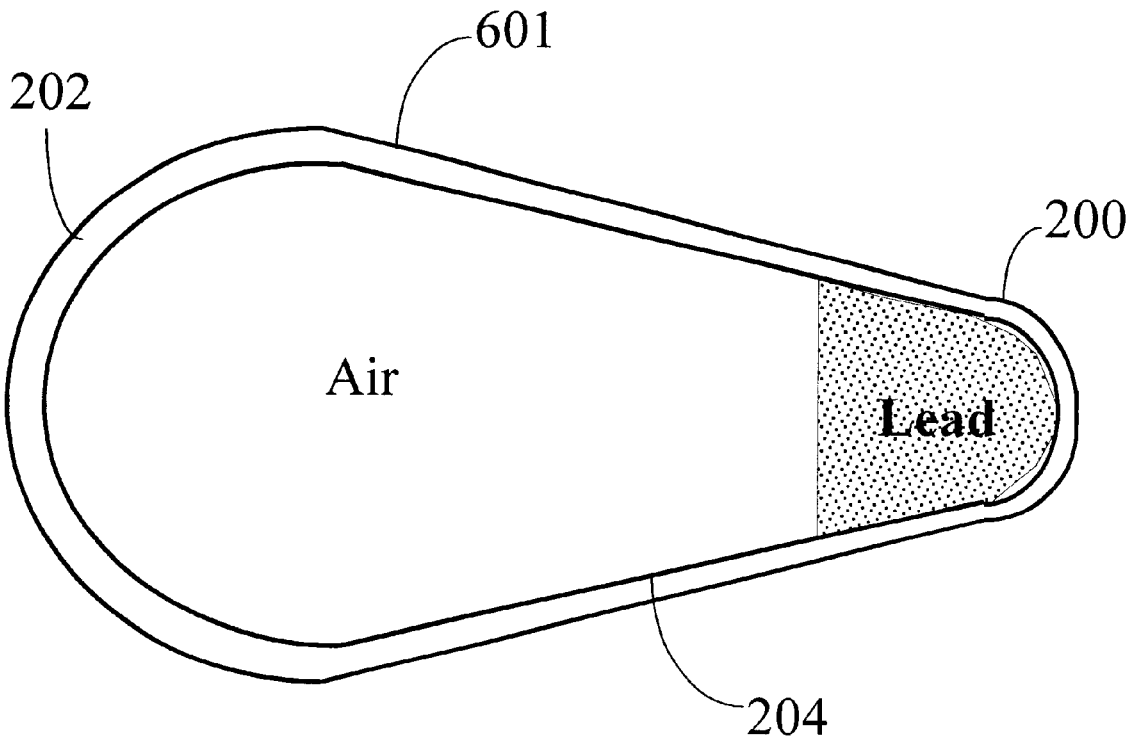
FIG. 6 depicts the enhanced kinetic energy projectile with advantageously located center of gravity.

Stability of the projectile during flight can be enhanced by locating the center of gravity as close to the front end as possible. One way to accomplish this is illustrated in FIG. 6. The projectile shown in this figure has the same external configuration as the projectile shown in FIG. 1 but larger, rear rounded end 202 and most of tapered segment 204 are hollow, being filled only with air, while smaller, front rounded end 200 and a fraction of the tapered segment are filled with lead. The rear rounded end and the front rounded end encompass a longer and a shorter radii, respectively. This concentration of heavy material at the nose of the projectile imparts greater in-flight stability to the projectile. As illustrated in FIG. 6, projectile 100 may comprise steel shell 601 of a pre-selected thickness and a lead insert in the front section of the projectile while the remainder of the interior space of the projectile is filled with air. The steel shell meets any non-toxicity requirement.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. An enhanced kinetic energy projectile shaped to maximize effective penetration while minimizing aerodynamic drag during flight, said projectile comprising: a steel shell having a pre-selected thickness and a hollow, air-filled interior, said steel shell assuming a teardrop shape, said shape comprising a front rounded end encompassing a first radius; a rear rounded end encompassing a second radius, said first radius being shorter than said second radius; a tapered section between said rounded ends; and a lead insert, said insert being positioned inside said shell adjacent to said front rounded end to impart greater in-flight stability to said projectile.

2. An enhanced kinetic energy projectile as set forth in claim 1, wherein said lead insert fills the interior of said front rounded end and a portion of said tapered section immediately adjacent to said front rounded end.

* * * * *